US005675914A

United States Patent [19]

Cintron

[11] Patent Number: 5,675,914

[45] Date of Patent: Oct. 14, 1997

[54] AIR CIRCULATING FOOTBED

[75] Inventor: Arthur G. Cintron, Marlboro, Mass.

[73] Assignee: The Rockport Company, Inc., Marlboro, Mass.

[21] Appl. No.: 557,757

[22] Filed: Nov. 13, 1995

[51] Int. Cl.[6] ..... A43B 7/06; A43B 13/38

[52] U.S. Cl. ..... 36/3 B; 36/44; 36/29; 36/29 R

[58] Field of Search ..... 36/3 R, 3 B, 29, 36/35 B, 43, 44

[56] References Cited

U.S. PATENT DOCUMENTS

| | | | |
|---|---|---|---|
| 1,176,445 | 3/1916 | Haran | 36/3 R |
| 1,211,542 | 1/1917 | Carolin | 36/3 R |
| 1,264,122 | 4/1918 | Paul | 36/3 R |
| 2,153,304 | 4/1939 | Gruber | 36/3 R |
| 2,292,318 | 8/1942 | Daly | 36/3 R |
| 2,474,815 | 7/1949 | Brahm | 36/3 R |
| 3,142,912 | 8/1964 | Larsen | 36/3 R |
| 3,335,505 | 8/1967 | Stec | 36/3 R |
| 3,426,455 | 2/1969 | Drago | 36/3 R |
| 3,475,836 | 11/1969 | Brahm | 36/3 B |
| 3,716,930 | 2/1973 | Brahm | 36/3 B |
| 4,215,492 | 8/1980 | Sandmeier | 36/3 B |
| 4,533,351 | 8/1985 | Wash kuhn | 36/140 |
| 4,776,109 | 10/1988 | Sacre | 36/3 B |
| 4,776,110 | 10/1988 | Shiang | 36/3 B |
| 5,282,324 | 2/1994 | Cheng | 36/3 R |
| 5,299,368 | 4/1994 | Liu | 36/3 B |
| 5,505,010 | 4/1996 | Fukuoka . | |

FOREIGN PATENT DOCUMENTS

| | | | |
|---|---|---|---|
| 362452 | 8/1938 | Italy | 36/3 B |

*Primary Examiner*—M. D. Patterson

*Attorney, Agent, or Firm*—Sterne, Kessler, Goldstein & Fox, P.L.L.C.

[57] ABSTRACT

A removable footbed is provided which circulates air and provides shock absorption. The footbed is constructed from a layer of moldable material molded with a concave bump in the heel area and a number of concave, intersecting channels in the remainder of the footbed. Both the concave bump and the channels have perforations which extend completely through the footbed and allow for the circulation of air in a shoe. The layer of moldable material is topped with a layer of anti-microbial foam for cushioning and bacteria prevention and which in turn is topped with a sock-contacting layer. The ventilation holes perforate the anti-microbial foam layer and the sock-contacting layer. A disc or cylindrically shaped open-celled foam sits within the concave bump to bias the bump in an upright position and a layer of shock absorbing material extends underneath the bump and the open-celled foam. The layer of moldable material may end at a step corresponding to the ball of a wearer's foot so as to increase forefoot flexibility.

20 Claims, 6 Drawing Sheets

AIR CIRCULATING FOOTBED

BACKGROUND OF THE INVENTION

1. Field of the Invention

The present invention relates generally to a footbed for a shoe, and more particularly to a removable footbed having an air circulating system independent of a surrounding shoe and capable of cooling substantially the entire underside of the foot while absorbing shock in the heel.

2. Related Art

An athletic or walking shoe is generally composed of an upper connected to a sole. The sole is generally composed of an outsole attached to a midsole. The upper is attached to the midsole. An insole may be disposed on top of the midsole and is surrounded by the shoe upper. A footbed is disposed within the shoe on top of the insole. The footbed is next to the foot when the shoe is worn. Because the footbed is in direct contact with the shoe wearer's foot, it is important that it be anatomically conformed to the wearer's foot and help the foot remain cool and comfortable when inside the shoe.

SUMMARY OF THE INVENTION

It is the primary object of the present invention to provide a removable footbed for a shoe which is capable of circulating air through the interior of the shoe. It is also an object of the present invention to provide an air-circulating footbed which does not destroy the integrity of the exterior of the shoe.

It is another object of the present invention to provide an improved footbed with a means in the heel area of the foot.

It is a further object of the present invention to provide an improved footbed which is simple to manufacture, may be placed in any standard shoe, and which does not deter from the flexibility of the forepart of the shoe.

It was with the foregoing needs and objectives in mind that the present invention was developed. The present invention relates generally to a self-contained air circulating footbed which has a multi-layered construction enabling it to provide the above-described objectives. The footbed has a top layer, sometimes called a sock-liner, which provides a sock-contacting surface as well as protection for the footbed and an area to display the manufacturer's information. The specific material of the top layer may be chosen depending on the nature of the type of shoe in which it will be used. Directly beneath the top layer, a layer of fabric backed anti-microbial foam is used for cushioning, as well as bacteria prevention. Beneath the layer of anti-microbial foam, a layer of molded EVA is attached. The layer of molded EVA is provided with a concave bump in an area corresponding to the wearer's heel and a system of interconnecting concave grooves in connection with the bump. The layer of molded EVA may end at an area corresponding to the ball of a wearer's foot. The lack of EVA in the forefoot area of the footbed significantly increases the flexibility of the footbed in that area.

A plurality of ventilation holes are stamped through the sockliner, anti-microbial foam layer, and the molded EVA layer in the middle of the channels. Lines of ventilation holes in the forepart area of the anti-microbial foam layer and sockliner provide small blasts of air from a bellows effect. They also serve as flex lines for increased flexibility. Perforations also pierce the three described layers in the concave bump. The perforations serve as a means to fill the concave bump with air and provide the heel area with blasts of air. When the heel of a wearer sits on the bump, the perforations are completely sealed, allowing the concave bump to act as a pump. Directly beneath the concave bump is a foam biasing means for biasing the concave bump in an upright position. Because the biasing means is made of foam, the air flow from the perforations in the concave bump to the concave grooves is not blocked. Below the biasing means is a layer of shock-absorbing material which sits in an indent in the molded EVA layer. In an area of significant impact, the shock-absorbing material makes up for the lack of EVA which is created by the concave bump.

BRIEF DESCRIPTION OF THE FIGURES

The foregoing and other objects, aspects, features and advantages of the present invention will be more fully appreciated as the same become better understood from the following detailed description of the present invention when considered in conjunction with the accompanying drawings, in which like reference characters designate the same or similar parts throughout the figures thereof, and in which.

DETAILED DESCRIPTION OF THE PREFERRED EMBODIMENTS

Figure 1:
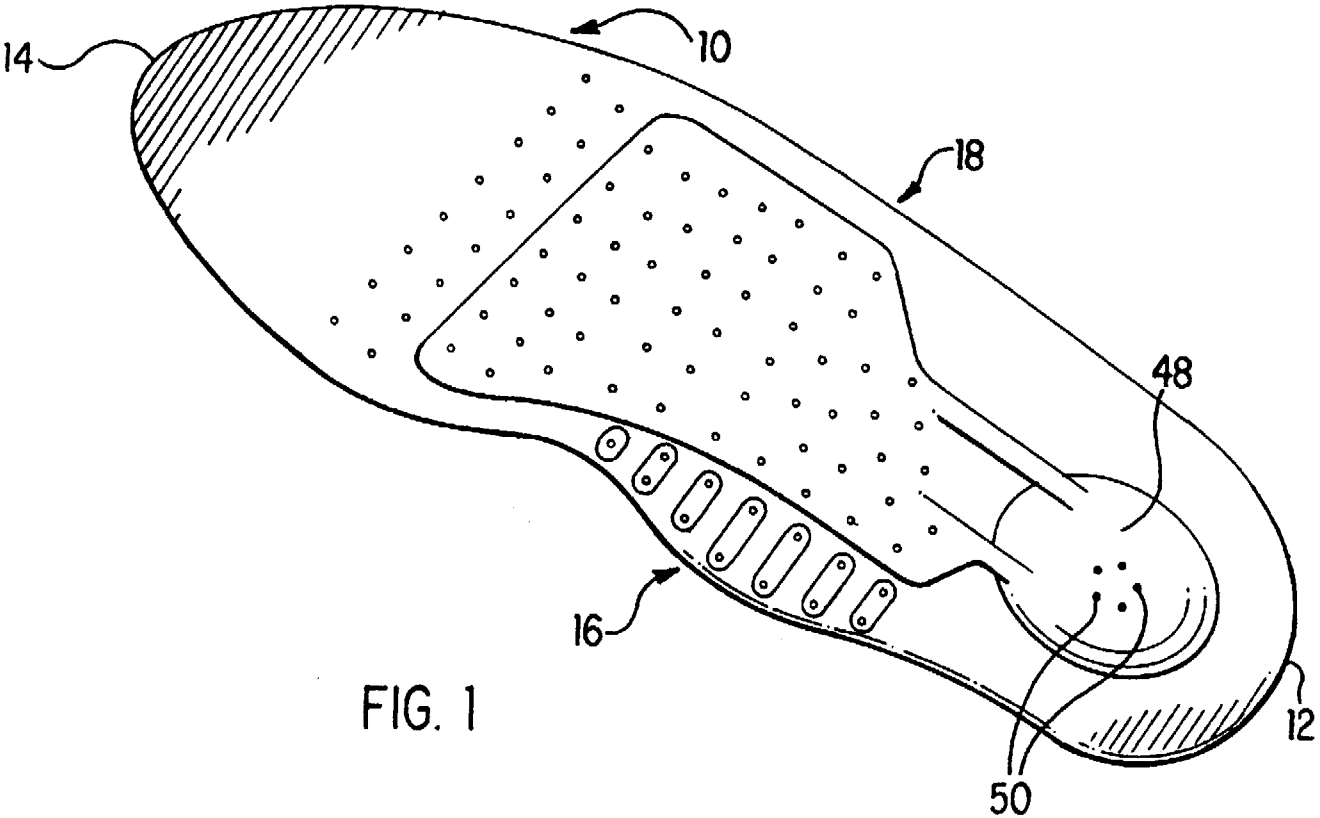
FIG. 1 shows a perspective view of a first preferred embodiment of the present invention.
Figure 3:
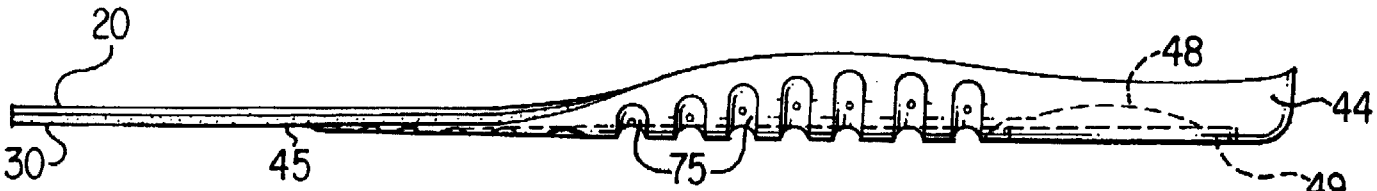
FIG. 3 shows a side view of the first preferred embodiment of the present invention.

Referring now to the drawings, and in particular to FIGS. 1–7, a first embodiment of a new and improved removable shoe insole having an air circulating system embodying the principles and concepts of the present invention and generally designated by the reference numeral 10 will be described. The figures are not necessarily to scale and the specific dimensions given below would be suitable for a men's size 9 shoe.

Although the figures depict a footbed for a shoe for the right foot, it is understood that the footbed of the present invention may encompass a footbed for a shoe for the left foot as well. A footbed for the left foot would have the mirror image of what is shown. A footbed 10, as shown generally in FIG. 1, has a medial side 16 and a lateral side 18. Footbed 10 also has a toe end 14 and a heel end 12. The length and width of footbed 10 is completely dependent upon the size of shoe into which footbed 10 will be placed.

Figure 2:
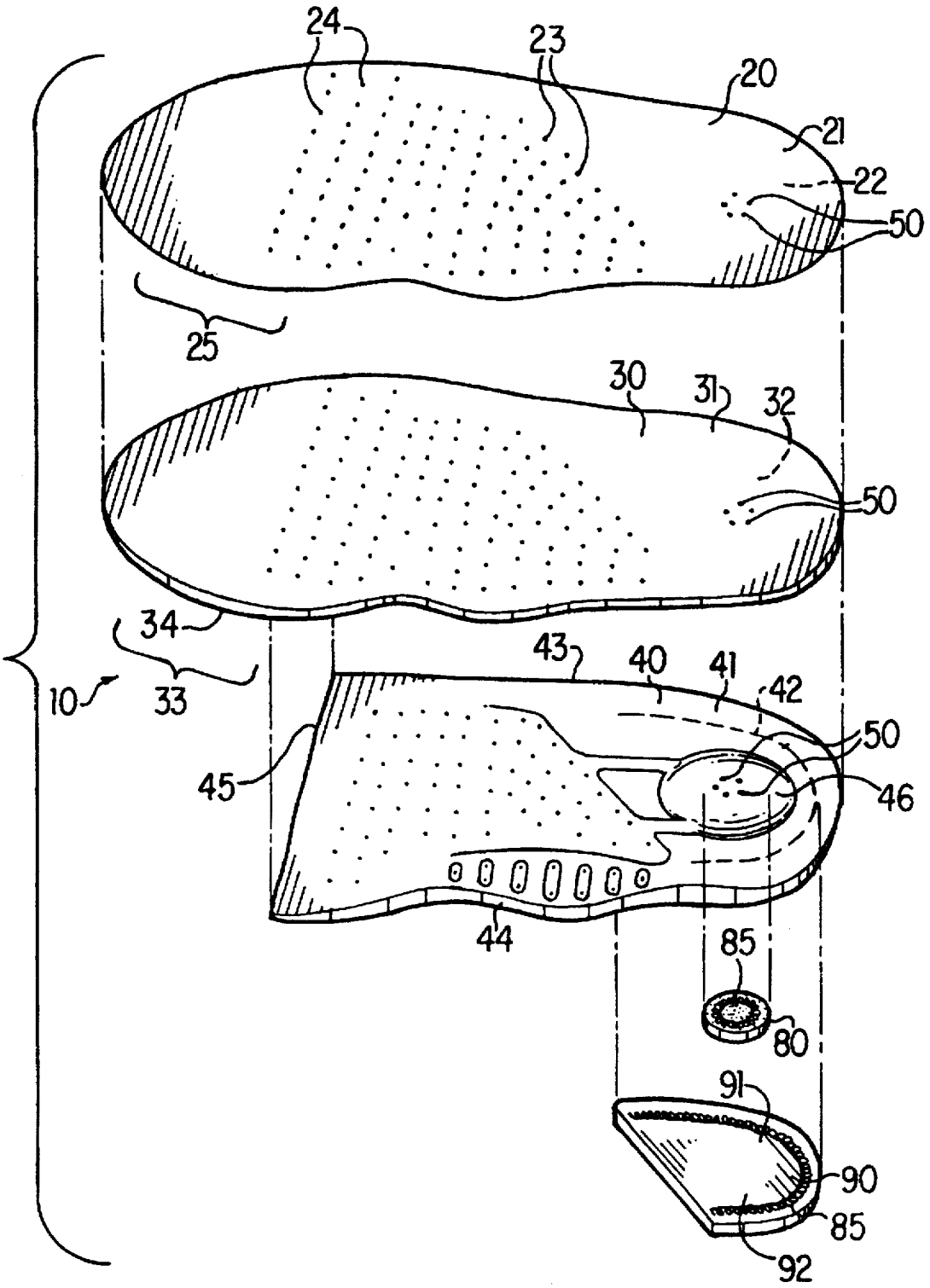
FIG. 2 shows an exploded view of the first preferred embodiment of the present invention.

FIG. 2 is an exploded view of footbed 10 in accordance with the first preferred embodiment of the present invention. Footbed 10 is shown to comprise three main layers. A first layer 20, sometimes called a sockliner, shoe sock, or insert sock, provides a layer between the wearer's foot and the footbed. First layer 20 has an upper surface 21 and a lower surface 22. Upper surface 21 of first layer 20 also defines the upper surface of footbed 10. First layer 20 may be made from a variety of materials including but not limited to grain leather, suede leather, PVC coated materials, or any other thin synthetic or natural material. The material selected will be determined by the type of footwear into which footbed 10 is intended to be placed. First layer 20 is used to provide general protection to footbed 10 from wear and also may be used to coordinate the footbed with a particular shoe. For example, an expensive dress shoe might use genuine leather in a shade corresponding to the shoe upper, or an athletic shoe might use terry cloth or another light, moisture absorbent material as is commonly employed in the sockliners of athletic shoes. Also, upper surface 21 of first layer 20 may be stamped with information which the footwear manufacturer wishes to convey to the purchaser of the shoe, e.g., manufacturer's name and trade mark, shoe name or number, country of origin, or size and width. It is important that first layer 20 be free from wrinkles or creases to avoid user discomfort.

Lying underneath first layer 20 and providing a foundation for first layer 20 is a second layer 30 which may comprise an anti-microbial foam material. Second layer 30 has an upper surface 31 and a lower surface 32. Upper surface 31 is entirely in contact with lower surface 22 of first layer 20. Lower surface 32 is backed with a fabric layer 34 to prevent the anti-microbial foam material from disintegration. Second layer 30 prevents the growth of microorganisms within the shoe which can lead to foot fungus and odor. One such anti-microbial foam material is Bayer Antimicrobias provided by Bayer Chemical Co. However, those skilled in the art will recognize that a variety of materials with similar properties could be substituted. One example of a suitable fabric for fabric layer 34 is cotton drill. Second layer 30 may have a thickness in the range of 1 mm to 4 mm, and preferably has a thickness of 2.5 mm. In addition to being anti-microbial, the foam material of second layer 30 provides cushioning and resiliency to footbed 10.

Lying directly underneath second layer 30 is a third layer 40. Third layer 40 has an upper surface 41 and a lower surface 42. The entire upper surface 41 is in contact with lower surface 32 of second layer 30. Third layer 40 is preferably made from a firm, compressible, lightweight, and moldable material 43 such as ethyl vinyl acetate (EVA). Third layer 40 has a sidewall 44. The height of sidewall 44 may be raised in a peripheral area surrounding an area corresponding to the arch and heel location of a wearer's foot to cup the foot in a conforming fashion. The height of the sidewall at the heel may be around 12 mm and the height of the sidewall at the arch area may be around 14 mm. Third layer 40 extends at least to a location corresponding to the ball of the foot. Therefore, third layer 40 extends from heel end 12 of footbed 10 to a location corresponding to about two-thirds the length of footbed 10. Although third layer 40 may extend the entire length of footbed 10, it is preferable that third layer 40 extends only to the location corresponding to the ball of the foot for increased forefoot flexibility. The front end of third layer 40 terminates at step 45. Thus, the height of sidewall 44 of third layer 40 may range from a minimum height at step 45, to a maximum height at a location corresponding to the arch area. To prevent user discomfort, it is preferred that the height and the thickness of step 45 be no greater than 0.5 mm. Also, to adequately conform to the shape of a shoe interior, the width of upper surface 41 is preferably greater than or equal to the width of lower surface 42.

Figure 6:
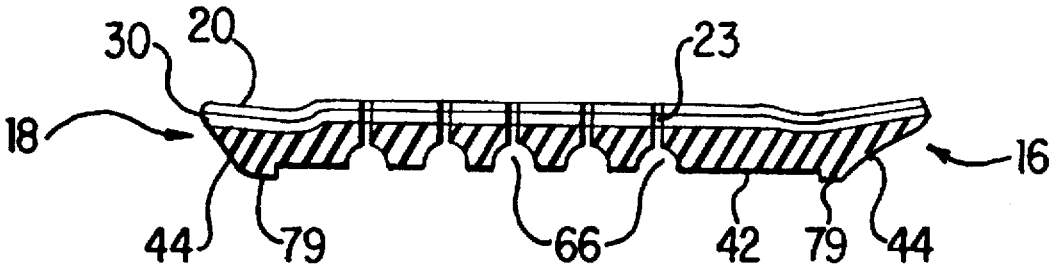
FIG. 6 shows a sectional view of a portion taken along the line 6—6 as shown in FIG. 4.
Figure 7:
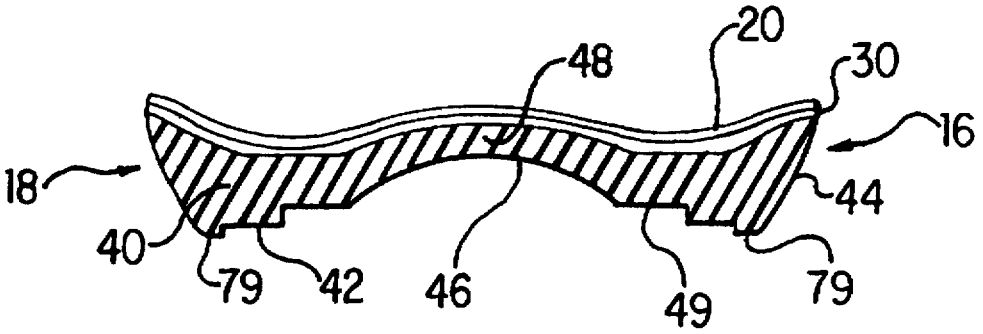
FIG. 7 shows a sectional view of a portion taken along the line 7—7 as shown in FIG. 4.

With reference to FIGS. 6 and 7, on lateral side 18 of footbed 10, sidewall 44 extends upwardly from lower surface 42 at a slightly obtuse angle, preferably between 95°–110°. Sidewall 44 extends from lower surface 42 at a greater obtuse angle on medial side 16, preferably between 110°–130°.

At a location corresponding to the heel of a foot is a circular concave bump 46 molded into bottom layer 40, as may be seen in FIG. 2. Middle layer 30 and top layer 20 are molded to conform around the convex portion of bump 46. Together, these three layers define a bubble 48 as shown in FIG. 1. At the top of bubble 48 are a number of perforations 50 which pierce through all three layers. Perforations 50 may be of any size large enough to allow the transmission of air, however it is preferred that perforations 50 have a diameter between 1 mm and 4 mm, and preferably a diameter of 2.5 mm. As shown in FIGS. 1 and 2, there are five perforations 50 arranged in a circular pattern located around the midpoint of bubble 48. Alternatively, there may be more or less perforations which pierce the three layer bubble construction and these perforations may be arranged in others patterns.

Figure 4:
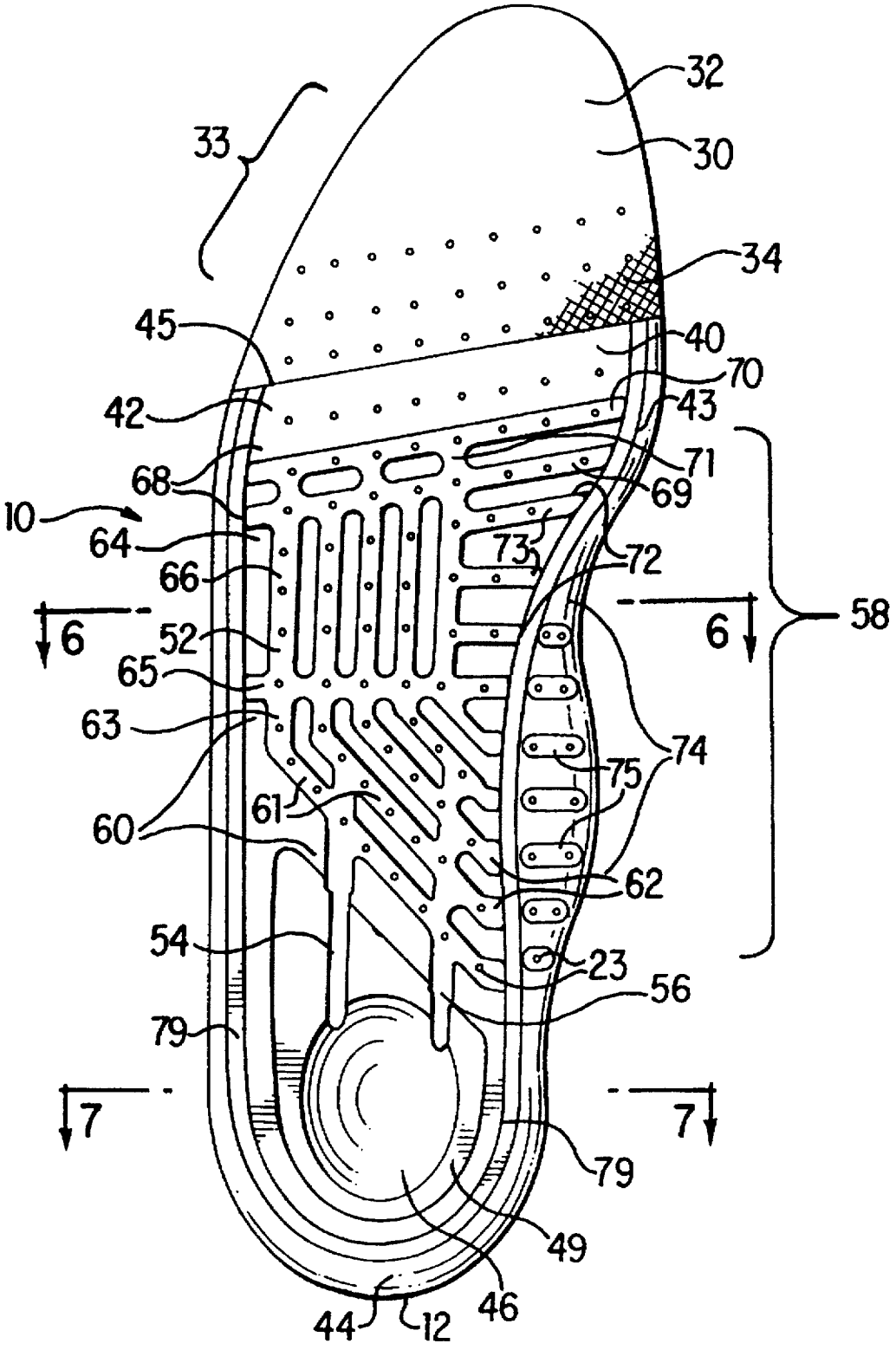
FIG. 4 shows a bottom plan view of the first preferred embodiment of the present invention.
Figure 5:
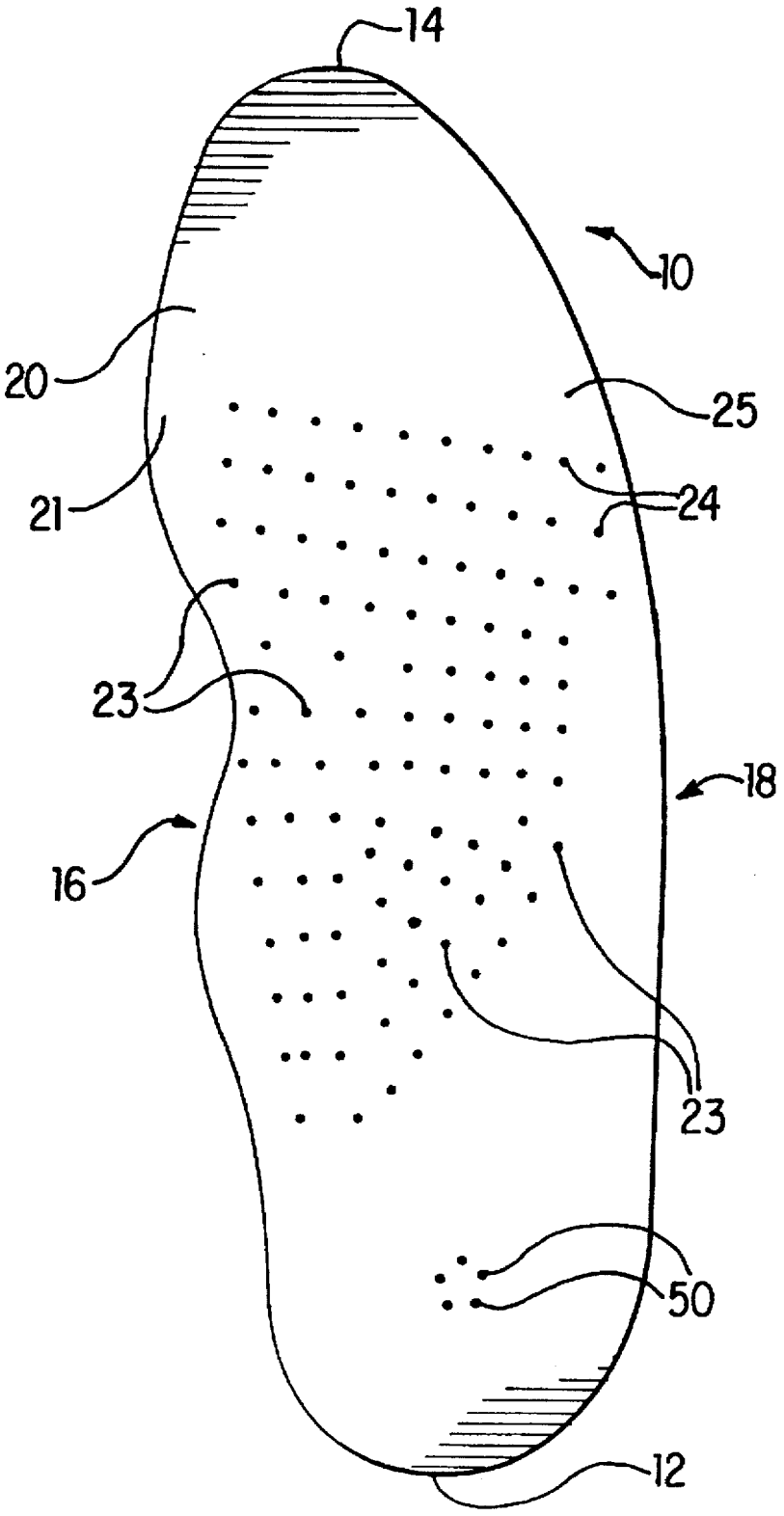
FIG. 5 shows a top plan view of the first preferred embodiment of the present invention.

As shown in FIG. 4, the material 43 of bottom layer 40 is molded by conventional molding techniques, such as injection molding, to form groove-like channels 52 in the bottom of footbed 10. Two main channels 54,56 extend from concave bump 46 and lead to an area of intersecting channels which will be referred to generally as the channel system 58. After applying anti-microbial layer 30 and top layer 20, the entire footbed 10 is stamped with a number of ventilation holes 23. The location of these ventilation holes 23 corresponds to the center of channels 52. Although ventilation holes 23 may be of any size capable of allowing air to pass through, ideally ventilation holes 23 are 1.5 mm in diameter.

Continuing with FIG. 4, channel system 58 has a number of channel areas, all of which are interconnected by channels 52. The channel areas are designed to optimize the number of channels 52 and the number of evenly spaced ventilation holes 23 in order to maximize the amount of air trapped between channels 52 and the shoe insole and the amount of air pushed through the ventilation holes 23. A first channel area 60 is in direct communication with main channels 54,56 and is in a heel section of footbed 10 nearest to the heel end 12 of footbed 10. First channel area 60 may have a series of diagonal channels 61. Main channels 54,56 intersect diagonal channels 61 at an angle. The medial-most side of diagonal channels 61 end in channel portions 62 which lie along a line connecting the medial 16 and lateral 18 sides of the footbed. The lateral-most side of diagonal channels 61 end in channel portions 63 which lie parallel to a line connecting toe end 14 and heel end 12 of footbed 10.

Separating first channel area 60 and a second channel area 64 is a dividing channel 65 which lies along a line connecting the medial 16 and lateral 18 sides of footbed 10 and which lies in the middle section of footbed 10. Second channel area 64 has a series of parallel, evenly spaced channels 66 which lie parallel to a line connecting toe end 14 and heel end 12 of footbed 10 and which lie in the middle section of footbed 10. Channels 66 are essentially continuations of channel portions 63 of first channel area 60.

A third channel area 68 is disposed closest to toe end 14 of footbed 10 and has at least two straight diagonal channels 69,70 which connect the medial 16 and lateral 18 sides of footbed 10. These straight diagonal channels 69, 70 of third channel area 68 may be interconnected by short channel portions 71 which lie substantially parallel to a line connecting toe end 14 and heel end 12 of footbed 10. First straight diagonal channel 69 is intersected by the front end portions of the parallel, evenly spaced channels 66 of the second channel area 64.

A fourth channel area 72 comprises a number of channels 73 which lie along lines connecting medial side 16 and lateral side 18 of footbed 10. Channels 73 may either be parallel to each other or slightly askew. Fourth channel area 72 is located on the medial side of second area 64, in back of third area 68, and in front of dividing channel 65.

A fifth channel area 74 comprises a number of channels 75 which are located on sidewall 44 in the area corresponding to the wearer's arch. Channels 75 may be clearly seen in FIG. 3, the medial side view of footbed 10. If sidewall 44 and bottom surface 42 of third layer 40 were to lie in the same plane, channels 75 would lie along lines which connect medial side 16 and lateral side 18 of footbed 10. Channels 75 may connect to or may be continuous extensions of channel portions 62 of first channel area 60, dividing channel 65, or channels 73 of fourth channel area 72.

The height or depth of channels 52 may range depending upon in which channel area channels 52 are located. Main channels 54,56 and the channels located in first channel area 60 may have a height of 3 mm, while the channels in third channel area 68 may have a height of only 1 mm. The reduced channel height in third channel area 68 is due to the fact that third channel area 68 is located nearest to a position corresponding to the ball area of the wearer's foot and third layer 40 tapers off at this location at step 45. During the wearer's walking gait, however, the increased pressure by the ball of the wearer's foot on third channel area 68 will create air movement through a bellows effect by the collapsing of channels 69,70 and thus, the ball of the wearer's foot will be provided with sufficient blasts of air despite the decreased height of the channels 69,70.

The width of channels 52 at lower surface 42 of third layer 40 may range from 4 mm to 7 mm. Channels 52 may be spaced apart by 3 mm to 6 mm. Depending on their location, channels 52 have a semi-circular to semi-oval cross-section.

Below bubble 48, a biasing means 80, shown in FIG. 2, such as an open-celled foam, is placed to bias bubble 48 in an upright position. Although materials other than open-celled foam may be used as a biasing means, it is desirable to use a material which will maintain an air flow path from perforations 50 to main channels 54,56. Biasing means 80 may be adhered to footbed 10 by an adhesive 85 which of course is placed about the peripheries of perforations 50 so as not to interrupt the communication between perforations 50 and main channels 54,56. Biasing means 80 may be disc or cylindrically shaped to fit easily within concave bump 46.

When employing bubble 48 as a pumping device, the heel of the wearer's foot during heel strike strikes bubble 48 with significant impact. The thickness of material 43 of third layer 40 is not as great at the region of greatest impact as it is in the material surrounding bubble 48. Therefore, a layer of shock-absorbing material 90 covers concave bump 46 and the beginning of the channels 54,56 to not only make up for the lack of material 43 that is underneath the heel of the foot, but also provide a means in which to concentrate the flow of air from bubble 48 to the remainder of footbed 10. The preferred material used for the layer of shock absorbing material 90 is PORON material supplied by Rogers Corporation of Rogers, Conn. Shock absorbing material such as PORON material will have significantly greater shock absorbing capabilities than the same thickness of the same EVA material 43 used for third layer 40. The layer of shock absorbing material 90 has an upper surface 91 and a lower surface 92. Bottom layer 40 may be molded with an indent 49, as shown in FIG. 4, to be slightly greater in size than the layer of shock-absorbing material 90 so that the layer of shock-absorbing material 90 fits within the indent 49 to provide a continuous planar bottom surface corresponding to the area underneath the heel of the foot. The upper surface 91 of the layer of shock-absorbing material 90 may be held onto the bottom of footbed 10 in indent 49 by adhesive 85, again placed so as not to block the flow of air from perforations 50 to main channels 54,56. The layer of shock-absorbing material 90 may have a thickness between 1 mm and 4 mm, and preferably has a thickness of 2.5 mm. Of course, the depth of indent 49 must correspond to the thickness of shock-absorbing material 90 to ensure that the bottom surface of footbed 10 is continuous and planar at a location corresponding to the heel area of the wearer's foot. Bottom surface 92 of the piece of shock-absorbing material 90 may have a special texture which would help footbed 10 maintain its position within the wearer's shoe and prevent it from shifting within the shoe. Biasing means 80 should extend at least as far in depth as the planar surface of indent 49, so as to be level with it.

The material 43 of third layer 40 may be molded to have a lip-like seal margin 79 (FIG. 4). Seal margin 79 defines the peripheral edges of lower surface 42 of third layer 40. Seal margin 79 helps ensure that the air pumped from bubble 48 into main channels 54, 56 remains underneath footbed 10 to travel through channel system 58 and escape through ventilation holes 23. The width of seal margin 79 is preferably 3 mm and its depth is preferably 1 mm. Seal margin 79 has a rounded cross-section as may be seen in FIGS. 6 and 7. Seal margin 79 may be provided with spaces on medial side 16 of footbed 10 which would allow air to transmit from channel portions 63 of first channel area 60, dividing channel 65, or channels 73 from fourth channel area 72 to channels 75 of fifth channel area 74, which is located on sidewall 44.

Because step 45 of third layer 40 may be at a location corresponding to the ball of a foot, lower surface 32 of second layer 30 becomes the bottom of footbed 10 at toe end 14 where third layer 40 is not present. The omission of third layer material 43 in the forepart area near to end 14 of footbed 10 ensures that the wearer is provided with the greatest amount of flexibility when wearing footbed 10. Top layer 20 and second layer 30 complete the remainder of footbed 10 by extending the entire length of the footbed. Thus, it is important that at least forepart section 33 of the second layer 30 be backed with fabric or other similar material to ensure the durability of footbed 10. Forepart section 33 of second layer 30, as well as the corresponding forepart section 25 of first layer 20, may also be provided with ventilation holes 24 to encourage air circulation all the way to the wearer's forefoot. In addition to assisting circulation, ventilation holes 24 in forepart section 33 of second layer 30 and forepart section 25 of first layer 20 serve to increase the flexibility of footbed 10. Ventilation holes 24 may be arranged in parallel lines which serve as flex lines to further increase the flexibility of footbed 10.

Figure 8:
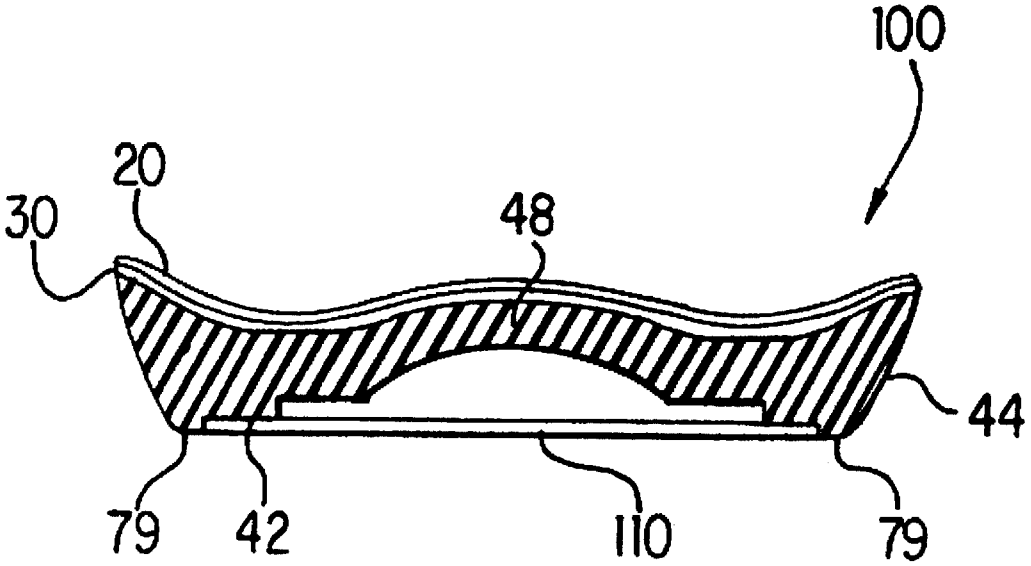
FIG. 8 shows a sectional view of a second preferred embodiment of the present invention.

In some instances, a shoe wearer may wish to insert the footbed inside a shoe which has an extremely porous insole or inside a shoe in which the footbed does not properly fit. In these cases, air can easily escape from the sides of the footbed or inside the insole and thus, the air contained underneath the footbed may not be enough to produce a noticeable ventilation effect to the underside of the wearer's foot. To overcome this problem, a second preferred embodiment of the present invention is shown in FIG. 8. A modified footbed 100 is shown generally at 100 composed of a single layer of material 110, such as a polyethylene film, adhered to lower surface 42 of third layer 40 at at least the seal margin 79. Alternatively, the material 110 may also be adhered to the planar areas of the lower surface 42 as long as it does not block any air flow in channels 52. When footbed 100 is placed inside a shoe with the deficiencies described above, a greater portion of the air circulated from main channels 54,56 may be discharged though ventilation holes 23.

In order to fully appreciate the present invention, implementation of footbeds 10 and 100 utilized in accordance with the present invention will now be described. In use, footbed 10 (and 100) is placed inside a conventional shoe with third layer 40 pressed in face-to-face contact with the insole of the shoe. Bubble 48 is in a location generally corresponding to the location where the wearer's heel will sit. As the wearer takes a step, the heel will contact bubble 48 and completely seal perforations 50 in the bubble. As the heel presses bubble 48, the heel will first be cushioned by biasing means 80 and then the shock of the heel landing will be absorbed by the piece of shock absorbing material 90. Any air that was within concave bump 46 will be forcefully pushed into main channels 54,56 and into channel system 58. Upon entering channel system 58, the air will first enter first channel area 60 and then will enter either dividing channel 65 or fifth area 74 (if seal margin 79 is provided with the channel adjoining spaces). Air may also further move into second channel area 64 and then into either third channel area 68 and fourth channel area 73. After air has been pushed into channels 52, the air will escape through ventilation holes 23, thus providing a substantial portion of the wearer's underfoot with a blast of air. When the heel disengages from bubble 48 as the foot rolls forward and weight is transferred to the toe, biasing means 80 will assist in pushing bubble 48 back into its upright position. Air from channel system 58 is allowed to rush back to concave bump 46 and some air will initially exit through perforations 50 to provide the heel with a small blast of air. In addition, when this weight shift occurs, the heel slightly separates from top layer 20 of footbed 10, allowing air from above to enter into concave bump 46 through perforations 50. In the preferred embodiment, because bottom layer 40 extends to only the area corresponding to the ball of the foot and because first socklining layer 20 and second anti-microbial layer 30 are provided with additional rows of ventilation holes 24, footbed 10 does not impede the forefoot flexibility of the surrounding shoe. Further, as ventilation holes 24 are pressed by the wearer's forefoot when walking, a bellows effect is created which provides the wearer's forefoot with blasts of air during the walking cycle.

While the invention has been described and illustrated as the various embodiments of a removable air circulating footbed, the description and illustrations of this invention are not intended to limit the invention to the details shown, but instead are illustrative only. It will be understood by those skilled in the art that various modifications and structural changes may be made, especially in matters of shape, size, arrangement of parts, and material of components within the principles of the invention without departing in any way from the spirit of the present invention. In particular, the specific dimensions mentioned may vary depending on the size of the shoe in which the described footbed is to be installed. Therefore, it is to be further understood that the invention is not limited to the specific embodiments thereof except as defined in the appended claims.

What is claimed is:

1. An air circulating footbed adapted to be removably inserted into a shoe, said footbed comprising:

a layer of moldable material having an upper surface and a lower surface and a concave bump molded therein, said layer of moldable material having at least one main channel molded in said lower surface and extending from said bump;

at least one perforation piercing said bump and extending completely through said upper surface to said lower surface of said layer of moldable material;

a system of intersecting channels molded in said lower surface of said layer of moldable material, said system of intersecting channels in communication with said at least one main channel, said system having a plurality of ventilation holes formed in said layer of moldable material; and a layer of shock absorbing material below said concave bump to absorb heel shock as a wearer's foot presses on said bump, said layer of shock absorbing material having an upper surface and a lower surface, said upper surface being adhered to said lower surface of said layer of moldable material allowing air flow to communicate between said concave bump and said at least one main channel;

whereby a foot pressing on said bump will seal said perforation on said bump and push air sitting below said bump through said at least one main channel, into said system of intersecting channels and out said ventilation holes.

2. An air circulating footbed according to claim 1, further comprising a layer of anti-microbial foam superposed on said layer of moldable material.

3. An air circulating footbed according to claim 2, further comprising a sockliner layer superposed on said layer of anti-microbial foam.

4. An air circulating footbed according to claim 3 wherein said layer of moldable material extends from a heel end of said footbed to a location corresponding to approximately two-thirds the length of said footbed and said layer of anti-microbial material and said sockliner layer define a forepart section of said footbed, said forepart section comprising a plurality of ventilation holes arranged in at least two parallel lines so as to serve as flex lines which increase the flexibility of said forepart area.

5. An air circulating footbed according to claim 4 wherein said layer of anti-microbial foam has an upper surface and a lower surface, said lower surface of said anti-microbial foam having a fabric backing in said forepart section of said footbed to protect said lower surface of said layer of anti-microbial foam from wear.

6. An air circulating footbed according to claim 2 wherein said layer of anti-microbial foam has a thickness of between approximately 2 mm and 3 mm to provide cushioning and resiliency to said footbed.

7. An air circulating footbed according to claim 1 further comprising a biasing means disposed below said concave bump to bias said concave bump in an upright position.

8. An air circulating footbed according to claim 7 wherein said biasing means is adhered to said concave bump in said layer of moldable material by an adhesive and wherein said biasing means and said adhesive do not block said at least one perforation in said bump.

9. An air circulating footbed according to claim 7 wherein said biasing means is a cylindrically shaped piece of open-cell foam.

10. An air circulating footbed according to claim 1 wherein said layer of moldable material tapers in height from an arch section of said footbed to a step disposed at a location corresponding to approximately two-thirds the length of said footbed, wherein said moldable material does not interfere with forefoot flexibility of said footbed.

11. An air circulating footbed according to claim 10 wherein the thickness of said layer of moldable material at said step is not greater than approximately 0.5 mm.

12. An air circulating footbed according to claim 1 wherein said layer of shock absorbing material has substantially greater shock absorbing capabilities per millimeter than an identical thickness of said layer of moldable material.

13. An air circulating footbed according to claim 12 wherein said layer of moldable material is molded with an indent slightly larger than said layer of shock absorbing material and surrounding said concave bump to enclose said layer of shock absorbing material to provide a substantially continuous surface on the bottom of said layer of moldable material below said concave bump.

14. An air circulating footbed according to claim 12 wherein said lower surface of said layer of shock absorbing material is of a texture which would prevent said footbed from shifting within a shoe.

15. An air circulating footbed according to claim 1 wherein peripheral edges of said layer of moldable material are molded so that when said footbed is placed in a shoe, the air pumped from said concave bump to said channel system is substantially enclosed between said footbed and the shoe.

16. An air circulating footbed according to claim 15 further comprising a continuous film layer which is attached at its periphery to said margin to further enclose air pumped from said concave bump to said channel system.

17. An air circulating footbed according to claim 1 wherein said layer of moldable material has a sidewall and wherein a channel of said system of intersecting channels is disposed on said sidewall on a medial side of said footbed.

18. An air circulating footbed according to claim 1 wherein the width of an upper surface of said footbed is not less than the width of a lower surface of said footbed.

19. A multi-layered, air circulating footbed for removable insertion into a shoe, said footbed comprising:

a first layer having an upper sockliner surface and a lower surface;

a second layer having an upper surface and a lower surface, said upper surface of said second layer in contact with said lower surface of said first layer, said second layer comprised of an anti-microbial foam with fabric backing defining said lower surface;

a third layer having an upper surface and a lower surface, said upper surface of said third layer in contact with said lower surface of said second layer, said third layer comprised of a compressible moldable material;

a circular concavity defined in said lower surface of said third layer;

a plurality of intersecting channels in connection with said concavity molded within said lower surface of said third layer;

a biasing means disposed within said circular concavity; and a layer of shock absorbing material disposed below said concavity to absorb heel shock as a wearer's foot presses on said concavity, wherein said layer of shock absorbing material has an upper surface and a lower surface, said upper surface is in contact with said lower surface of said third layer allowing air flow to communicate between said concavity and said plurality of intersecting channels, said shock absorbing material having greater shock-absorbing capabilities than said moldable material of said third layer.

20. An air circulating footbed having a backpart section nearest to a heel end of said footbed, a forepart section nearest to a toe end of said footbed and a middle section disposed between said heel end and said toe end, said footbed adapted to be removably inserted inside a shoe, said footbed comprising:

a layer of moldable material having an upper surface, a lower surface, and a sidewall, said lower surface of said layer of moldable material partially defining lower surface of said footbed;

a circular concave indent molded within said lower surface of said layer of moldable material near said heel end of said footbed at a location corresponding to a location where a heel of a wearer's foot would sit;

a main channel consisting of a concave groove extending from said circular concave indent and parallel to a line connecting said toe end and said heel end of said footbed;

a first channel area disposed in said backpart section having a plurality of concave grooves in communication with said main channel;

a second channel area in said middle section near a lateral side of said footbed, said second channel area having a plurality of concave grooves parallel to a line connecting said toe end and said heel end of said footbed;

a dividing channel disposed in said middle section of said footbed having a single concave groove parallel to a line connecting a medial side and said lateral side of said footbed and located between said first channel area, and said second channel area;

a third channel area in an area of said forepart section nearest to said middle section of said footbed having a plurality of concave grooves, said concave grooves of said third channel area extending from said medial side to said lateral side of said footbed, said third channel area in direct communication with said second channel area;

a fourth channel area in said middle section near said medial side of said footbed having concave grooves and in direct contact with said medial side of said second channel area;

and a fifth channel area on said sidewall on said medial side of said footbed having concave grooves;

wherein said main channel is imperforate and wherein each concave groove of said first channel area, said dividing channel, said second channel area, said third channel area, said fourth channel area, and said fifth channel area is provided with at least one ventilation hole which extends from a lower surface of a footbed to an upper surface of said footbed.

* * * * *